US007001352B2

(12) United States Patent
Farrell et al.

(10) Patent No.: US 7,001,352 B2
(45) Date of Patent: Feb. 21, 2006

(54) DYNAMIC RESTING HAND SPLINT

(75) Inventors: John F. Farrell, Morehead City, NC (US); Henry B. Hoffman, Mt. Pleasant, SC (US)

(73) Assignee: Saebo, Inc., Charlotte, NC (US)

( * ) Notice: Subject to any disclaimer, the term of this patent is extended or adjusted under 35 U.S.C. 154(b) by 239 days.

(21) Appl. No.: 10/373,438

(22) Filed: Feb. 25, 2003

(65) Prior Publication Data

US 2003/0162634 A1 Aug. 28, 2003

Related U.S. Application Data

(60) Provisional application No. 60/359,810, filed on Feb. 25, 2002.

(51) Int. Cl.
*A61F 5/00* (2006.01)

(52) U.S. Cl. ..... 602/21; 602/22

(58) Field of Classification Search ..... 128/878, 128/879; 602/20, 21, 22; 601/40; 482/444
See application file for complete search history.

(56) References Cited

U.S. PATENT DOCUMENTS

| | | | | | |
|---|---|---|---|---|---|
| 4,602,620 | A | | 7/1986 | Marx | |
| 4,765,320 | A | | 8/1988 | Lindemann et al. | |
| 4,772,012 | A | * | 9/1988 | Chesher | 482/47 |
| 4,875,469 | A | * | 10/1989 | Brook et al. | 601/40 |
| 4,945,902 | A | | 8/1990 | Dorer et al. | |
| 4,949,711 | A | * | 8/1990 | Gyovai et al. | 602/21 |
| 5,514,052 | A | * | 5/1996 | Charles et al. | 482/47 |
| 5,560,375 | A | | 10/1996 | Kabanek | |
| 5,637,078 | A | | 6/1997 | Varn | |
| 5,807,293 | A | | 9/1998 | Wedge, Jr. | |
| 2003/0195093 | A1 | * | 10/2003 | White | 482/124 |

* cited by examiner

*Primary Examiner*—Michael A. Brown
(74) *Attorney, Agent, or Firm*—Tillman Ivsan, PLLC; Chad D. Tillman

(57) ABSTRACT

A dynamic splint for the positioning and functional exercise of a neurologically impaired upper extremity, including the wrist, hand and fingers, made up of a forearm support and hand support linked by a first connector. Fingertip caps are connected to finger tension leads that extend rearwardly to connect to a finger tensioner attached to the forearm support. The hand support includes adjustable tension lead guides for directing the finger tension leads to the fingertip caps. The dynamic splint also includes a thumb splint assembly made up of a thumb-tip cap connected to a thumb tension lead that extends rearwardly to a thumb tensioner attached to the forearm support. The thumb splint assembly further includes a thumb tension lead guide for directing the thumb tension lead to the thumb-tip cap.

29 Claims, 2 Drawing Sheets

DYNAMIC RESTING HAND SPLINT

This application claims the benefit of U.S. Provisional application Ser. No. 60/359,810 filed Feb. 25, 2002.

BACKGROUND OF THE INVENTION (1) Field of the Invention

The present invention relates to a dynamic wrist-hand-finger orthosis or splint. In particular, the invention is well suited for the positioning and exercise of a neurologically impaired upper extremity, including the wrist, hand, and fingers.

(2) Description of the Prior Art

A dynamic wrist-hand-finger orthosis or splint is generally used for the positioning of an impaired, injured, or disabled wrist, hand, and fingers. Splints come in a variety of designs: static, static progressive, and dynamic that can be low profile or high profile.

U.S. Pat. Nos. 5,637,078 and 5,560,375 describe static rigid splints designed to hold the wrist, hand, and fingers in a static position. These splints are used following an injury, during surgery, and post surgery. They are generally made of aluminum with a cushion liner or plastic with a padded liner.

U.S. Pat. No. 4,945,902 describes a static progressive splint as one applying an infinitely adjustable progressive force to a finger, two adjacent fingers, or the thumb. A static progressive splint is designed to increase range of motion to shortened soft tissue.

U.S. Pat. No. 4,765,320 describes the use of a dynamic "low profile" splint to offer a tension force to the finger to overcome stiffness and immobility due to an injury or the hand being immobilized for a period of time. The patent also mentions that whenever possible the patient should be able to perform normal tasks with the splint in place.

U.S. Pat. No. 4,602,620 discloses a prefab splint outrigger system to be used in conjunction with a thermoplastic base. The disclosed system is for use on the postoperative hand for the precise alignment of dynamic splint forces following implant resection arthroplasty of the metacarpophalangeal joints.

All of the above-mentioned prior art and current splints are orthopedic in nature that either holds the hand in a static functional position, or uses a slight dynamic force to position the fingers. None of the known prior art is neurologically based and is designed to allow the user to exercise the impaired upper extremity including the wrist, hand, and fingers.

Many people suffering a neurological injury from stroke, cerebral palsy, brain injury, etc., often have upper extremity impairments. Many have some shoulder and elbow movements, but are unable to extend their wrist or fingers to grasp an object. This is usually due to hypertonicity, described in U.S. Pat. No. 5,807,293 as a condition where the flexor or extensor muscles in the upper extremities is spastic, and resists positioning.

Currently, dynamic splints offer slight resistance to hold a joint in a certain position. An effective dynamic splint designed to be used for hypertonicity must offer enough force to balance the effects of increased muscle tone (hypertonicity). Also current dynamic splints use a variety of finger cuffs to support the digits. These cuffs are not practical when working on a digit affected by hypertonicity, as they move proximal upon closing the fingers, and then have to be repositioned after opening the fingers manually.

Thus, there is a continuing need for a dynamic splint that will address these prior art deficiencies, and provide the user with an improved way to exercise an impaired upper extremity including the wrist, hand and fingers.

SUMMARY OF THE INVENTION

The present invention is directed towards a dynamic splint that exercises a rehabilitating hand by providing resistance to the hand's fingers and thumb. The invention is especially useful for returning the fingers and thumb to an open or extended position after a grasping motion.

The dynamic wrist, hand and finger orthosis or splint is designed for use with the neurologically impaired upper extremity. The splint is used to hold the user's impaired wrist, hand and fingers generally in an extended position, with the thumb in palmer abduction. This position places the impaired hand in the functional position for grasping. The splint also has a dynamic component that offers varying degrees of substantial resistance to all digits, unlike current dynamic splints. The thumb has its own tensioner, and the other four digits, i.e., the fingers, have a combined tensioner, or can have individual tensioners as needed. It is this dynamic force that assists with releasing the object once grasped.

The dynamic splint includes digit caps that can transfer the force of resistance without moving proximally on the finger, and are then able to be opened with the assistance of tensioners. The splint of the invention allows a neurologically impaired upper extremity, including the hand to work on repetitive grasp and release activities while participating in task specific arm training. The benefits of incorporating the neurologically involved hand in upper extremity functional activities have been well documented.

Generally, the dynamic splint of the present invention is comprised of a support having a forearm section and a hand section positioned at an upward angle to the forearm section; a plurality of digit or tip caps for attachment to the user's fingers and thumb; and tensioning means to urge the tip caps upwardly, thereby urging the user's fingers from a gripping position to an open position. The tensioning means is generally comprised of a plurality of longitudinally adjustable leads, i.e., cords or lines, that extend rearwardly from the tips to tensioners, i.e, tension-creating elements, such as extended springs that are attached to the support.

In order to correctly position the tips relative to the support, and to properly align the leads, the dynamic splint also includes a plurality of guides, one for each tip, that extend from the support to adjacent the tips. Each guide includes a lead opening, such as a grommet, with each lead being threaded through a grommet. The guides are preferably longitudinally adjustable, as well as rotatably or laterally adjustable, so that the distal ends of the guides can be positioned to locate the tips at desired positions, taking into account the size of the user's hand and fingers. For example, each guide can be attached to the support with a screw that fits within a longitudinal slot.

The forearm section of the support is a generally rigid band, e.g, a curved plastic sheet, that is sized to fit substantially around a user's forearm. An attachment means, such as one or more hook-and-loop straps are attached to the forearm section to secure the section to the user's forearm. The inner surface of the forearm section can be lined with padding material for comfort. The hand section of the support is generally a rigid plate that is sized to cover a substantial portion of the dorsal part or back of the hand. A releasable attachment means, such as a hook-and-loop strap can be used to secure the hand section to the back of the hand. The inner surface of the hand section can also be padded.

The thumb tip guide used to position the thumb-tip cap is preferably a rod that is rotatably mounted on the support, so that thumb tip guide can be positioned at the appropriate angle. For example, the thumb tip guide can be formed of a rod with proximal and distal sections that are at an angle. The proximal section may be rotatably mounted in substantial longitudinal alignment with the longitudinal axis of the forearm section, so that the distal section of the thumb tip guide is angled outwardly, enabling the distal end of the guide to be positioned over the thumb-tip cap.

In operation, the dynamic splint creates rearwardly directed forces that urge the fingers and thumb into an open hand, fingers extended position. Specifically, the finger tensioner constantly pulls on each finger tension line connected to the fingertip caps urging each finger into an extended position. However, the resistance provided by the tensioner is not so great as to prevent the fingers from moving towards a gripping position. Likewise, the thumb tensioner constantly pulls on the thumb tension line to urge the extension of the thumb, but does so with less force than would prevent the thumb from closing.

These and other aspects of the present invention will become apparent to those skilled in the art after a reading of the following description of the preferred embodiment.

DETAILED DESCRIPTION OF THE INVENTION

Figure 1:
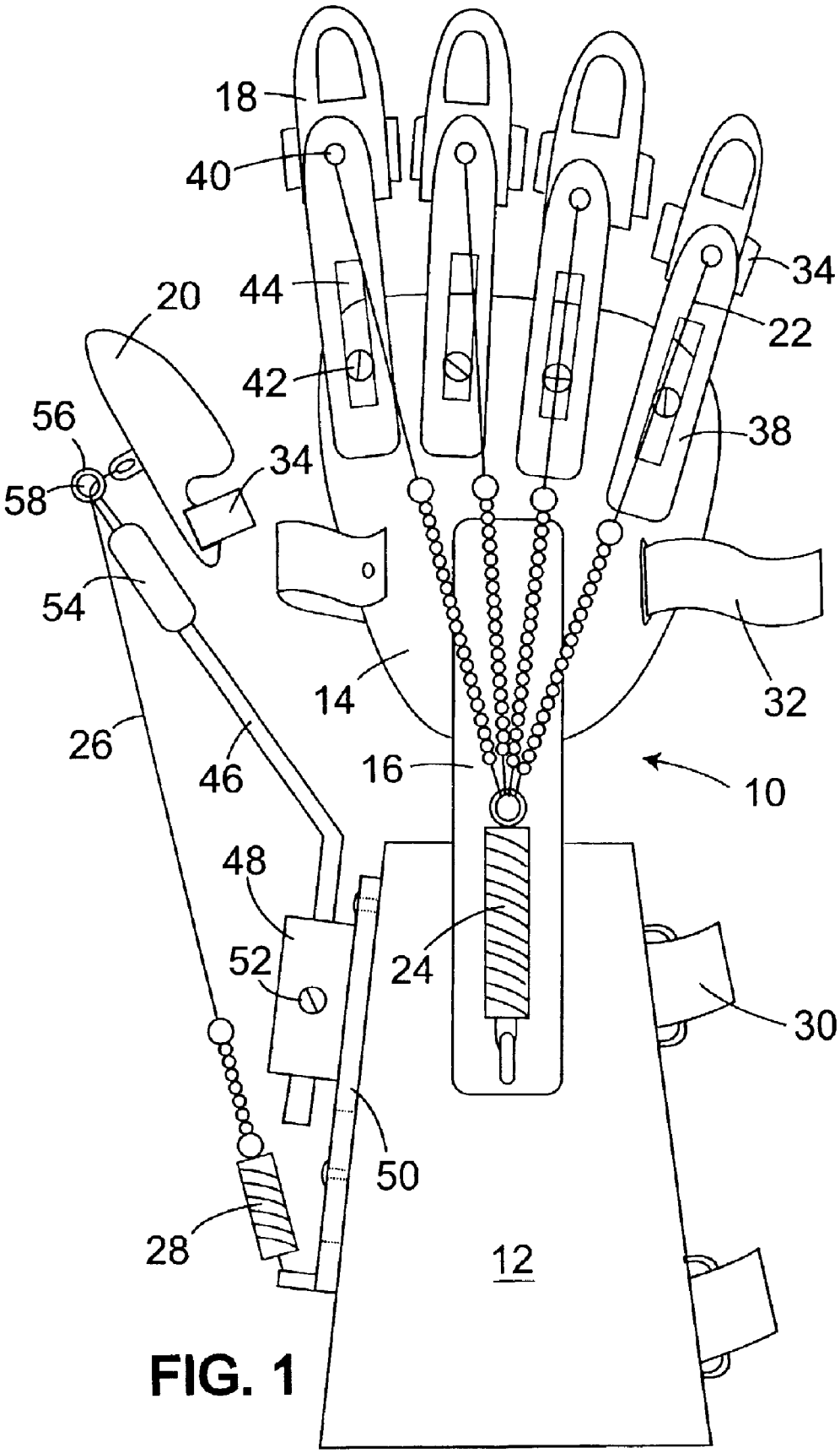
FIG. 1 is a top view of the dynamic splint.
Figure 2:
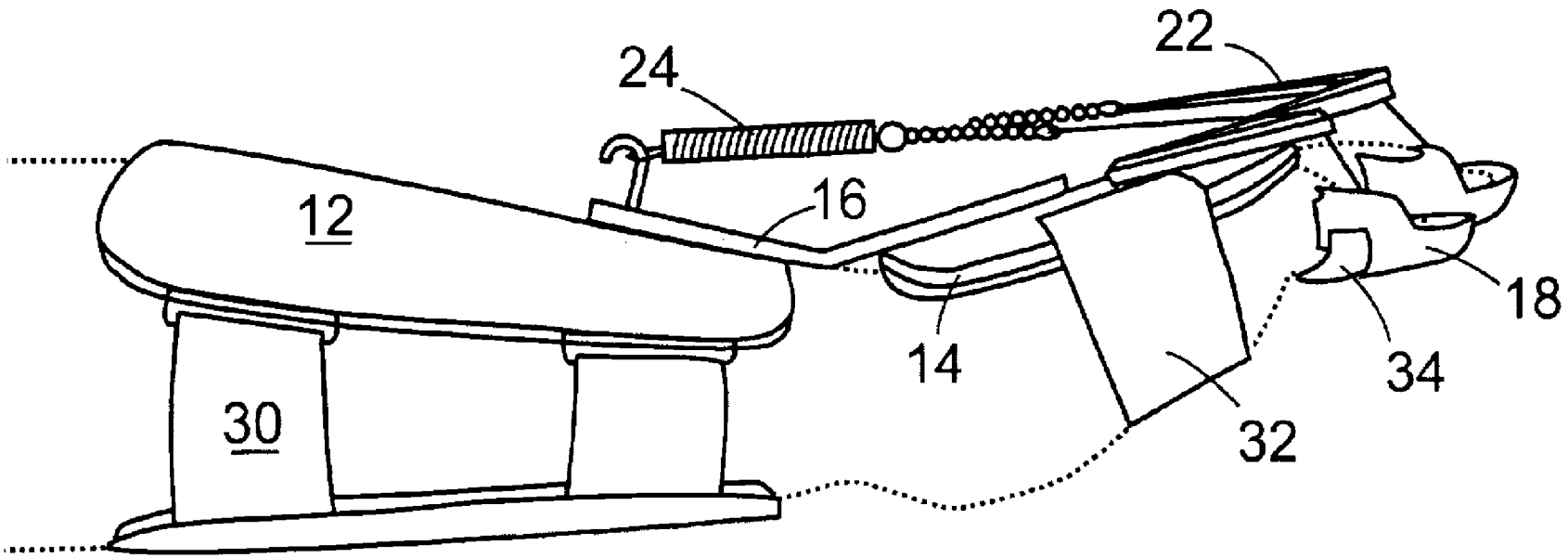
FIG. 2 is a side view of the dynamic splint.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As illustrated in the drawings, a preferred embodiment of the dynamic splint, generally 10, of the present invention is comprised of a forearm support 12, a hand support 14, a support connector 16 to connect forearm support 12 and hand support 14 at an upward angle of approximately 25° to 45° degrees, preferably about 35°, raising the user's hand upwardly. A plurality of fingertip caps 18 are positioned over the tips of the user's fingers, while a thumb-tip cap 20 is positioned over the tip of the user's thumb.

In order to urge fingertip caps 18 from a gripping position to an open position, splint 10 further includes a plurality of adjustable finger tension leads 22 having distal ends attached to fingertip caps 18. The proximal ends of leads 22 are attached to finger tensioner 24, which is a spring in the preferred embodiment. Tensioner 24 is secured at its proximal end to forearm support 12. Similarly, a thumb tension lead 26 has a distal end attached to thumb-tip cap 20. A thumb tensioner 28, also a spring in the preferred embodiment, connects the proximal end of thumb tension lead 26 to forearm support 12 to urge thumb-tip cap 20 from a gripping position to an open position. Releasable attachment straps 30, 32, 34 and 36, which are hook-and-loop fasteners in the preferred embodiment, are used to attach forearm support 12, hand support 14, finger tip caps 18 and thumb-tip cap 20, respectively.

Splint 10 also includes adjustable finger tension lead guides 38 to position fingertip caps 18 at the desired longitudinal and lateral locations in relation to hand support 14. Lead guides 38 have proximal ends adjustably attached to hand support 14 and distal ends including lead grommets or openings 40. Guides 38 may be adjusted longitudinally and rotatably to longitudinally and laterally adjust the positions of openings 40. As shown in the preferred embodiment, adjustment is effected by an adjustment screw 42 that is adjustably positioned in a longitudinal slot 44. Each of finger tension leads 22 extends through an opening 40.

Splint 10 also includes a thumb tension lead guide 46 in the form of a bent rod having a proximal end rotatable within a longitudinal bore in mounting block 48. Mounting block 48 is supported on an adjustable base 50 that is slotted at to permit longitudinal and transverse adjustment. A setscrew 52 in block 48 is tightened against guide 46 once guide 46 is in the desired location, holding guide 46 is a fixed position. The longitudinal bore is aligned with the longitudinal axis of forearm support 12. The distal end of thumb tension lead guide 46 includes a threaded coupling nut 54 and thumbscrew 56 to longitudinally adjust guide 46. Thumbscrew 56 includes a bore 58, with thumb tension lead 26 extending through bore 58.

In operation, forearm support 12 is attached around the user's arm with hand support 14 being positioned on the back of the user's hand. Finger tip caps 18 are secured to the user's finger tips and thumb-tip cap 20 is secured to the user's thumb. Finger lead guides 38 are adjusted so that opening 40 is positioned approximately over finger tip caps 18. The distal end of a lead 22 is attached to each of finger tip caps 18 and strung through on opening 40 of a guide 38, and then rearwardly to connect to spring tensioner 24. The lengths of leads 22 are adjusted to place leads 22 under tension, so that tension 24 urges leads 22 rearwardly and thereby urges the user's finger tips from a gripping position to an open position.

Thumb tension lead guide 46 is rotatably positioned within mounting block 48 to a desired position and locked with setscrew 52, and thumbscrew 56 is positioned adjacent the desired location for thumb cap 20. The distal end of thumb tension lead 26 is attached to thumb-tip cap 20 and extends through bore 58 to thumb tensioner 28. The length of lead 26 is also adjusted to place lead 26 under tension, so that tensioner 28 urges leads 26 rearwardly and thereby urges the user's thumb from a gripping position to an open position.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A dynamic splint for a hand, wrist and fingers comprising:

a) a support having at forearm section and a hand section connected to said forearm section;

b) a plurality of fingertip caps and a thumb tip cap; and c) a plurality of adjustable tensioned leads attached to said caps to urge said caps toward an open position;

d) wherein said leads are attached to tensioners to maintain said leads under tension; and e) wherein said finger tip caps are connected by leads to a first tensioner and said thumb tip cap is connected by a lead to a second tensioner.

2. The dynamic splint of claim 1, wherein said hand section is angled upwardly relative to said forearm section.

3. A dynamic splint for a hand, wrist and fingers comprising:

a) a forearm support;
b) a hand support;
c) a support connector connecting said forearm and hand supports;
d) a plurality of fingertip caps;
e) a plurality of finger tension leads having distal ends attached to said fingertip caps acid proximal ends; and
f) a finger tensioner connected to said forearm support and the proximal end of at least one of said tension leads to urge at least one of said fingertip caps toward an open position from a gripping position.

4. The dynamic splint of claim 3, wherein said forearm support is a hand sized to fit substantially around a forearm.

5. The dynamic splint of claim 4, wherein said forearm support includes at least one releasable attachment strap adapted to secure said forearm support around a user's forcarm.

6. The dynamic splint of claim 3, wherein said hand support is generally a rigid plate that is sized to cover a substantial portion of the back of a user's hand.

7. The dynamic splint of claim 6, wherein said hand support includes at least one releasable attachment strap adapted to secure said hand support to the back of a user's hand.

8. The dynamic splint of claim 3, wherein said support connector is angled to position the hand support at an angle relative to said forearm support.

9. The dynamic splint of claim 3, wherein said hand support further includes adjustable finger tension lead guides for positioning said fingertip caps in relation to said hand support.

10. The dynamic splint of claim 3, wherein said fingertip caps each have a releasable strap adapted to secure said fingertip cap to a user's finger.

11. The dynamic splint of claim 3, further including a thumb splint assembly comprised of a thumb-tip cap, a thumb tension lead having a distal end attached to said thumb-tip cap and a proximal end, and a thumb tensioner attached to said thumb tension lead proximal end and said forearm support.

12. The dynamic splint of claim 11, further including an adjustable thumb tension lead guide for positioning said thumb-tip cap in relation to said hand support.

13. The thumb splint assembly of claim 11, wherein said thumb-tip cap includes a releasable strap adapted to secure said thumb-tip cap to a user's thumb.

14. A dynamic splint for a hand, wrist and fingers comprising:
a) a forearm support;
b) a hand support;
c) a support connector connecting said forearm and hand supports;
d) a plurality of fingertip caps;
e) a plurality of finger tension leads having distal ends attached to said fingertip cups and proximal ends;
f) a finger tensioner connected to said forearm support and the proximal end of at least one of said tension leads to urge at least one of said fingertip caps toward an open position from a gripping position;
g) a thumb-tip cap;
h) a thumb tension lead having a distal end attached to said thumb-tip cap and a proximal end; and
i) a thumb tensioner attached to said thumb tension lead proximal end and to said forearm support.

15. The dynamic splint of claim 14, wherein said forearm support has a C-shaped cross-section and is adapted to partially encircle a user's forearm.

16. The dynamic splint of claim 14, wherein said support connector includes a distal end attached to said hand support and a proximal end attached to said forearm support, said support connector positioning said hand support at an angle relative to said forearm support.

17. The dynamic splint or claim 16, wherein said angle is approximately 35 degrees.

18. The dynamic splint of claim 14, wherein said tensioner is a spring.

19. The dynamic splint of claim 14, further including adjustable finger tension lead guides for positioning said fingertip caps in relation in said hand support, said guides having proximal ends attached to said hand support and distal ends including lead openings, each of said finger tension leads extending through the lead opening of a finger tension lead guide.

20. The splint of claim 19, wherein said lead guides are both longitudinally and laterally adjustable.

21. The dynamic splint of claim 19, further including a thumb tension lead guide having a proximal end attached to said forearm support and a distal end including a lead opening, said thumb tension lead extending through the lead opening of said thumb tension lead guide.

22. The dynamic splint of claim 19, wherein said thumb tension lead guide is rotatable.

23. The dynamic splint of claim 19, further including a thumb tension lead guide mount with a longitudinal bore aligned with said forearm support carried on said forearm support, said thumb tension lead guide having a proximal end rotatable in said bore and an outwardly extending distal end.

24. A dynamic splint for a hand, wrist and fingers comprising:
a) a forearm support;
b) a hand support attached to said forearm support;
c) a plurality of fingertip caps;
d) a thumb-tip cap;
e) a plurality of finger tension leads having distal ends attached to said fingertip caps and proximal ends;
f) a thumb tension lead having a distal end attached to said thumb-tip cap and a proximal end;
g) a finger tensioner connected to said forearm support and the proximal ends of said finger tension leads to urge at least one of said fingertip caps toward an open position from a gripping position;
h) a thumb tensioner attached to forearm support and the proximal end of said thumb tension lead to urge said thumb-tip cap toward an open position from a gripping position; and
i) adjustable lead guides to position the fingertip and thumb-tip caps in relation to said hand support, said guides having proximal ends attached to said hand support and distal ends including lead openings, each of said tension leads extending through the lead opening of a lead guide.

25. The dynamic splint of claim 24, wherein said thumb tension lead guide is rotatable.

26. The dynamic splint of claim 24, further including a thumb tension lead guide mount with a longitudinal bore aligned with said forearm support carried on said forearm support, said thumb tension lead guide having a proximal end rotatable in said bore and an outwardly extending distal end.

27. A dynamic splint for a hand, wrist and fingers comprising:
a) a support having a forearm section and a hand section adapted for placement on the dorsal part of the hand connected to said forearm section;

b) a plurality of fingertip caps and a thumb tip cap;

c) a plurality of adjustable tensioned leads attached to said caps to urge said caps toward an open position; and d) a plurality of lead guides attached to said hand section, said guides having distal ends with lead openings adjacent to said tips.

28. The dynamic splint of claim 27, wherein said guides are longitudinally and laterally adjustable.

29. A dynamic splint for a hand, wrist and fingers comprising:

a) a support having a forearn section and a hand section adapted for placement on the dorsal part of the hand connected to said forearm section;

b) a plurality of fingertip caps and a thumb tip cap; and c) a plurality of adjustable tensioned leads attached to said caps to urge said caps toward an open position, said fingertip caps being connected by leads to a first tensioner and said thumb tip cap being connected by a lead to a second tensioner.

* * * * *

UNITED STATES PATENT AND TRADEMARK OFFICE

CERTIFICATE OF CORRECTION

PATENT NO. : 7,001,352 B2
APPLICATION NO. : 10/373438
DATED : February 21, 2006
INVENTOR(S) : John F. Farrell et al.

It is certified that error appears in the above-identified patent and that said Letters Patent is hereby corrected as shown below:

Column 4, line 54, change the word "at" to --a-- so that line 54 reads as follows: --a) a support having a forearm section and a hand section--

Column 5, line 7, change the word "acid" to --and-- so that line 7 reads as follows: --attached to said fingertip caps and proximal ends; and--

Column 5, line 17, change the word "forcarm" to --forearm-- so that line 7 reads as follows: --forearm.--

Column 5, line 55, change the word "cups" to --caps-- so that line 7 reads as follows: --attached to said fingertip caps and proximal ends;--

Column 6, line 6, change the word "or" to --of-- so that line 6 reads as follows: --17. The dynamic splint of claim 16, wherein said angle is--

Column 6, line 12, change the second occurrence of the word "in" to --to-- so that line 12 reads as follows: --fingertip caps in relation to said hand support, said guides--

Column 6, line 45, add the word --said-- between the words "to" and "forearm" so that line 45 reads as follows: --h) a thumb tensioner attached to said forearm support and the--

Column 8, line 1, change the word "forearn" to --forearm-- so that line 1 reads as follows: --a) a support having a forearm section and a hand section--

Signed and Sealed this

Twenty-first Day of October, 2008

JON W. DUDAS
*Director of the United States Patent and Trademark Office*